US005916394A

United States Patent [19]

Prochaska et al.

[11] Patent Number: 5,916,394

[45] Date of Patent: Jun. 29, 1999

[54] CAULKING SUPPORT STRIP AND METHOD

[76] Inventors: Kevin F. Prochaska, 14855 Marquette, Moorpark, Calif. 93021; Robert P. Hobbs, 12604 Rossiter Ave., Sylmar, Calif. 91342; Stanley W. Tyler, 16668 Near-View Dr., Canyon Country, Calif. 91351; Arly Maldonado, 14960 Oswald, Sylmar, Calif. 91342

[21] Appl. No.: 08/788,458

[22] Filed: Jan. 28, 1997

[51] Int. Cl.[6] ..... B32B 31/00; B32B 31/20

[52] U.S. Cl. ..... 156/83; 156/71; 156/275.7; 156/281; 52/741.4

[58] Field of Search ..... 428/314.4, 317.1, 428/317.3, 317.7, 343, 355 R, 41.8, 220, 304.4, 306.6, 332, 352, 354; 156/83, 273.7, 275.7, 308.2, 71, 281; 52/741.4

[56] References Cited

U.S. PATENT DOCUMENTS

| | | | |
|---|---|---|---|
| 4,366,284 | 12/1982 | Ishido et al. | 524/447 |
| 4,382,999 | 5/1983 | Harima et al. | 428/494 |
| 4,837,085 | 6/1989 | McGroarty . | |
| 5,326,634 | 7/1994 | Sato et al. | 428/314.4 |
| 5,370,115 | 12/1994 | Ogawa et al. | 128/639 |
| 5,614,311 | 3/1997 | Morita et al. | 428/317.3 |
| 5,693,393 | 12/1997 | Harada | 428/40.1 |

*Primary Examiner*—Marie Yamnitzky
*Attorney, Agent, or Firm*—Koppel & Jacobs

[57] ABSTRACT

A layer of compressed cellulose sponge is coterminously attached to a length of two-sided adhesive tape to form a caulking support strip. The support strip is used to provide a surface that bridges gaps between two surfaces that are to be caulked along their intersection, through which caulking would otherwise fall. In use, the tape's peel-off strip is removed and the support strip is pressed into position near the corner formed by the two surfaces to be caulked. The support strip is then moistened, causing the sponge layer to transform from its compressed to its expanded state and bridging the gap between the surfaces, providing a support surface which is firm enough to support a bead of caulking.

5 Claims, 3 Drawing Sheets

CAULKING SUPPORT STRIP AND METHOD

BACKGROUND OF THE INVENTION

1. Field of the Invention

This invention relates to the field of caulking products, particularly those for use in bridging a gap between two surfaces which are to be caulked.

2. Description of the Related Art

Caulking is a water-based latex or silicone-based material which is widely used to provide a seal between two surfaces which are typically perpendicular to each other, such as where the side of a bathtub meets the floor or a cabinet meets the wall. An L-shaped corner is formed where the two surfaces intersect, and caulking is applied along the length of the corner. Caulking is usually supplied in an air-tight tube which, when squeezed, expels a bead of material with a toothpaste-like, easily malleable consistency. The bead is directed and pressed into the corner and allowed to dry. The caulking hardens as it dries to form a seal between the two surfaces.

A problem can occur, however, when one or both of the surfaces to be caulked is uneven, so that gaps appear along the corner formed by the two surfaces. A bathroom or kitchen countertop provides a good example: a countertop typically has a "backsplash", a vertical section of countertop material usually about 10 to 15 cm (3.94" to 5.91") high and about 2.5 cm (0.98") wide which runs the length of the countertop along its edge. A backsplash is positioned against a wall when the countertop is installed and caulking is applied in the L-shaped corner formed by the wall and the top of the backsplash. If the wall and the back of the backsplash are parallel to each other, there will be little to no gap between the top of the backsplash and the wall, and caulking can be applied directly in the corner formed between them. However, the average house does not have perfectly flat walls, and considerably wide gaps can occur in areas along the typically 8–12 foot long intersection between wall and backsplash. Gaps of more than about 0.32 cm (⅛") are generally too wide to be bridged by the bead of caulk, which falls between the backsplash and the wall. Repeated attempts to bridge such a gap usually result in a considerable amount of lost caulking and unsightly lumps in the seal that might eventually be created.

A need exists for a way to fill a gap between two surfaces so that it may be caulked.

SUMMARY OF THE INVENTION

A product and method are presented which solve the problems and satisfy the needs noted above. A caulking support strip is made from a thin, narrow layer of an expandable material with compressed and expanded states and has an adhesive applied to one of its sides. The support strip is placed against one of the two surfaces between which unacceptably large gaps are present, held in position by the adhesive. The strip is made to expand, which bridges the gap between the surfaces and provides a support surface upon which a bead of caulking can be applied.

The expandable material is preferably a compressed cellulose sponge material which is preferably about 0.16 cm (1/16") thick in its compressed state. The adhesive is preferably an adhesive tape which is sticky on both sides, with one sticky side bonded to the sponge and the exposed sticky side covered by a non-sticky peel-off strip. The tape preferably has the same width and length as the layer of sponge to which it is coterminously attached. In use, the peel-off strip is removed and the product is pressed into position on one of the two surfaces which are separated by a gap. When moistened, the sponge transforms from its compressed to its expanded state to bridge the gap. The expanded sponge provides a surface which is firm enough to support a bead of caulking, and remains in place long after the caulking has dried. Sponge materials having different compressed thicknesses are used to accommodate gaps of various widths.

Further features and advantages of the invention will be apparent to those skilled in the art from the following detailed description, taken together with the accompanying drawings.

BRIEF DESCRIPTION OF THE DRAWINGS

FIGS. 4*a*–7*a* are plan views showing a method for bridging a caulking gap per the present invention.

FIGS. 4*b*–7*b* are sectional views which correspond to the plan views in FIGS. 4*a*–7*a,* respectively, showing a method for bridging a caulking gap per the present invention.

DETAILED DESCRIPTION OF THE INVENTION

Figure 1A:
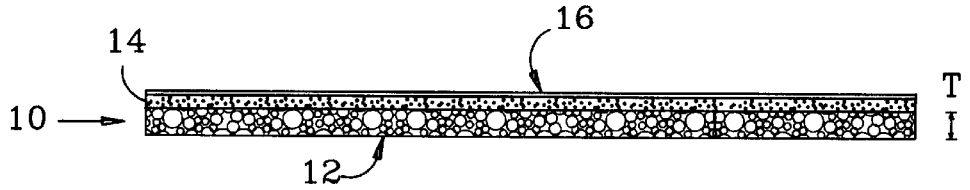
FIGS. 1*a* and 1*b* are elevation and plan views, respectively, of an embodiment of the present invention with a caulking support strip in its compressed state.

As shown in FIG. 1*a,* caulking support strip 10 includes a layer of expandable material 12, with an adhesive 14 applied to one side of the material. The adhesive is preferably covered with a non-sticky peel-off strip 16. A "layer" as used herein refers to a piece of material having a fixed width and length. The caulking support strip is preferably in the form of a long, narrow, thin strip that is less than 2.5 cm (0.98") wide and at least 15 cm (5.91") long. The preferred embodiment of the caulking support strip is about 1.27 cm (½") wide, less than 0.32 cm (⅛") thick, and about 30.5 cm (12") long.

Figure 2A:
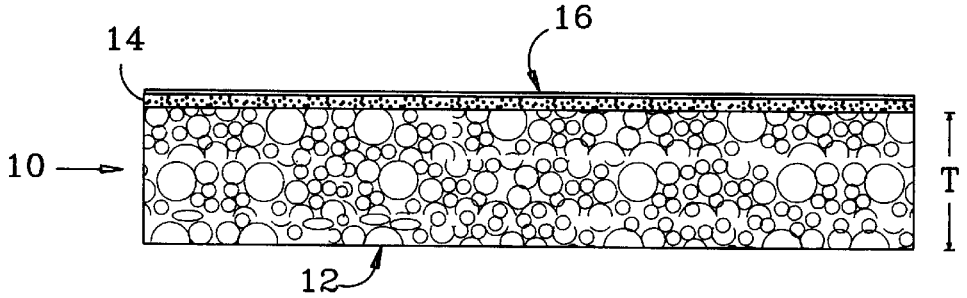
FIGS. 2*a* and 2*b* are elevation and plan views, respectively, of the caulking support strip of FIGS. 1*a* and 1*b* in its expanded state.

The expandable material 12 has a compressed state, shown in FIG. 1*a,* and an expanded state, as shown in FIG. 2*a.* The expandable material remains in its compressed state naturally, i.e., no external forces are needed to keep it compressed, until some action is taken to cause it to transform into its expanded state. A compressed cellulose sponge material is preferred. Compressed cellulose sponge is an inexpensive, readily-available man-made material which is particularly well-suited to this application. It is supplied in its compressed state, and is available in a variety of compressed thicknesses. It is transformed from its compressed to its expanded state simply by applying a small amount of water to the sponge material. When expanded, the sponge presents a surface which is firm and flat enough to support a bead of caulking. The sponge stays in its expanded state after drying, and remains so indefinitely.

A compressed cellulose sponge's expanded thickness is related to its compressed thickness. When expanded, the sponge should be able to bridge the kinds of gaps encountered between surfaces to be caulked (which are typically no more than 1.27 cm (½") wide), and its compressed thickness should be thin enough to be easily handled and conveniently packaged. The preferred cellulose sponge material has a compressed thickness T of less than 0.32 cm (⅛")— preferably about 0.16 cm (1/16"), which expands to at least 1.27 cm (½")—preferably to about 1.59 cm (⅝")—when moistened. Sponge materials having greater expanded thicknesses are obtainable, but these require a correspondingly thicker compressed state.

Figure 1B:
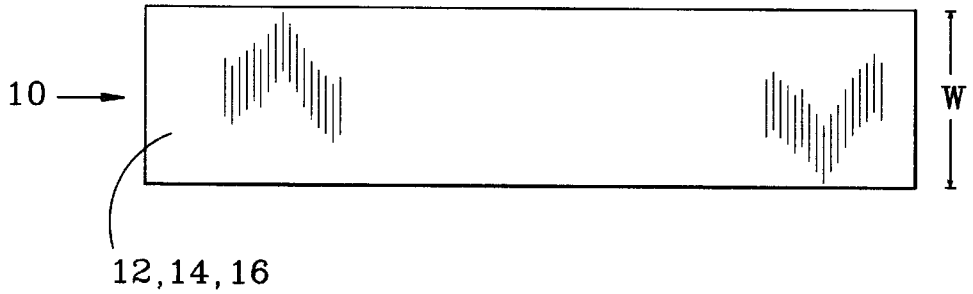
Figure 2B:
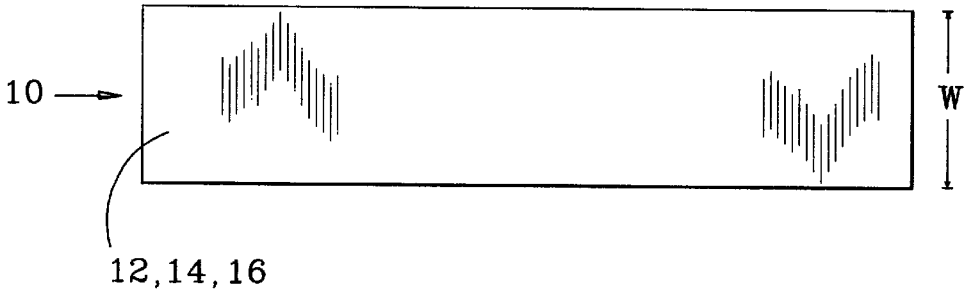

Caulking is typically applied along the length of the corner formed at the intersection of two surfaces, with "intersection" defined to include the points at which the two surfaces physically meet, as well as the points at which the surfaces would meet if extended along their respective planes but for the existence of a gap between them. As described in detail below, the caulking support strip 10 is positioned on one of the surfaces on either side of the gap, just below the corner to be caulked. When the sponge expands, it preferably provides a support surface that bridges the gap while staying below the corner, so that caulking can be applied in the corner without interference from the support strip. Thus, the preferred sponge material only expands in the direction of thickness; as shown in the plan views of FIGS. 1*b* and 2*b*, the width W of the support strip does not change significantly between its compressed and expanded states. The width of the support strip is not critical. A width of about 1.27 cm (½") has been shown to provide an adhesive area adequate to keep the caulking support strip in place while caulking is applied, as well as being a convenient size to handle and package.

Other materials could serve as the expandable material as well. For example, a natural sea sponge material, or an inflatable plastic strip, could possess compressibility and expandability attributes similar to that of a cellulose sponge. However, due to its low cost and simplicity of operation, compressed cellulose sponge is preferred. This type of sponge is typically supplied in the form of a compressed sheet with a specified compressed thickness. Sheets of the preferred cellulose sponge (compressed thickness specified to be 0.16 cm (1/16")) are available from several sources, including Minnesota Mining and Manufacturing Company (3M), in St. Paul, Minn., for example.

A caulking support strip 10 made from a compressed cellulose sponge material is expanded by applying water along the strip's full length, by dampening with a wet rag or spray bottle. Other methods of moistening the strip are acceptable, as long as the strip is not subjected to so much pressure that it is pulled away from the surface to which it is attached. The amount of water used is not critical: if more water is used than is needed to fully expand the support strip, the excess will eventually evaporate. If not enough water is used, the support strip will not expand to its maximum thickness, which is remedied with an additional application of water.

The caulking support strip 10 is attached to a surface with an adhesive 14 which is applied to one side of the expandable material layer 12. Adhesive 14 is preferably a two-sided adhesive tape (sticky on both sides), with one sticky side in contact with the expandable material layer 12, and the other sticky side preferably covered with non-sticky peel-off strip 16, which enables the support strip to be more easily packaged and handled than if the sticky side were exposed. An adhesive tape which is sticky on only one side is acceptable, but a means must then be provided by which the non-sticky side of the tape is affixed to the expandable material layer, with glue, for example. Use of a two-sided adhesive tape avoids this requirement.

An adhesive tape serving as adhesive 14 is preferably the same width and length as the expanding material layer 12, and the tape and expandable material layer are preferably coterminous when assembled together, i.e., they have coincident boundaries both lengthwise and widthwise. This relationship is preferred because an adhesive tape which is narrower than the expanding material layer 12 to which it is attached may present an adhesive area which is insufficient to hold the support strip in place, while an adhesive tape that is wider than its corresponding expandable material layer may make the resulting support strip difficult to handle.

Figure 3A:
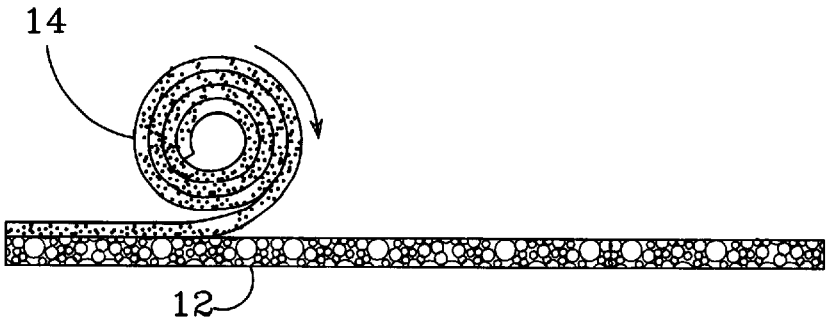
FIGS. 3*a*–3*c* are elevation views showing a method for securely affixing adhesive tape to a sponge material.

The adhesive 14 must be able to maintain its adhesion in the presence of water, must have the adhesive strength necessary to hold the expanded sponge while it supports a bead of caulking, and must be able to keep the support strip in position until the caulking has dried (which typically requires about 6 to 8 hours) . It was noted during the development of the invention that if an adhesive tape is simply rolled onto a sponge material by hand, the tape tends to separate from the sponge when it gets wet. This tendency was found to be markedly reduced if the following assembly steps are performed, which are shown in FIGS. 3*a*–3*c*:

1) FIG. 3*a*: Roll the adhesive tape 14 onto the sponge 12.

Figure 3B:
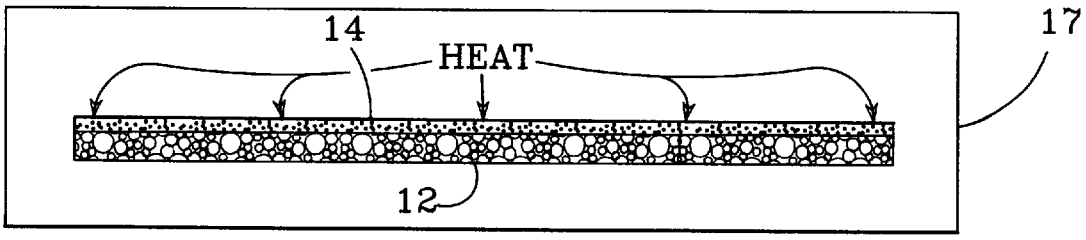

2) FIG. 3*b*: Expose the tape 14 and sponge 12 to a temperature of about 93.3–107.2 degrees C. (200–225 degrees F.), for a period of about 15–20 seconds. This can be accomplished, for example, by briefly placing the tape and sponge in a temperature chamber 17 (FIG. 3*b*).

Figure 3C:
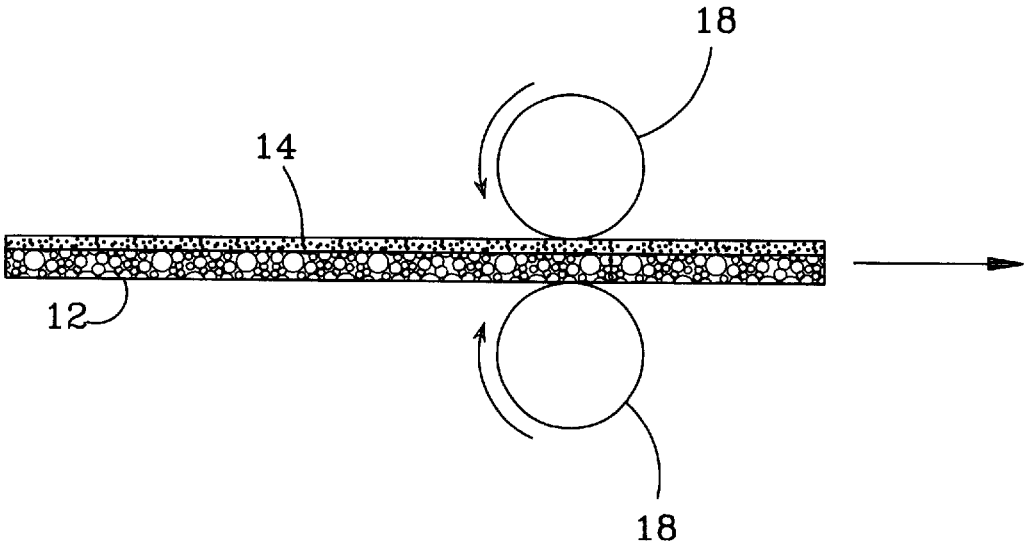

3) FIG. 3*c*: Pass the tape 14 and sponge 12 through a pinch roller 18 adjusted to apply about $8.24\times10^5$ N/m$^2$ (120 psi) of pressure.

This method of assembly is recommended to help securely adhere two-sided adhesive tape to compressed cellulose sponge material. Many commonly available varieties of two-sided tape should perform satisfactorily if these steps are followed. One particular two-sided tape, product number 61998 manufactured by Anchor Continental, Inc. in Columbia, S.C., has been used successfully after being attached to a compressed cellulose sponge layer per the procedure above. This tape is supplied in roll form with a non-sticky peel-off strip placed on both sides of the tape; the peel-off strip is removed from one side of the tape before rolling the tape onto the sponge layer.

"Adhesive 14" refers to any means of providing areas of stickiness on one side of the expanding material layer 12. For example, a sticky coating that can be sprayed or brushed onto layer 12, or a type of glue requiring water to activate, are each acceptable adhesives. It is not necessary that one entire side of expandable material 12 be covered with adhesive—making the support strip sticky at just two or three points may be sufficient to hold it in place; this may not, however, provide enough adhesive strength to maintain the strip in position while caulking is applied and allowed to dry. Two-sided adhesive tape is preferred because of its low cost and ready availability, the ease with which it is attached to the sponge, the adhesive strength it provides, and the peel-off strip with which it is typically supplied.

Caulking support strips per the present invention can be prepared with a wide range of widths and lengths. Cellulose sponge is typically supplied in sheet form, and can be cut as needed. Similarly, tape is supplied in a wide range of widths and lengths, and can be cut to match the dimensions of the cut sponge. The preferred dimensions for a general purpose caulking support strip are about 1.27 cm (½") in width and about 30.5 cm (12") long. A number of such support strips are placed end-to-end to accommodate the installation of a long countertop, for example. Caulking support strips as described herein can be used with all known types of caulking, including water-based latex and silicone types.

Figure 4A:
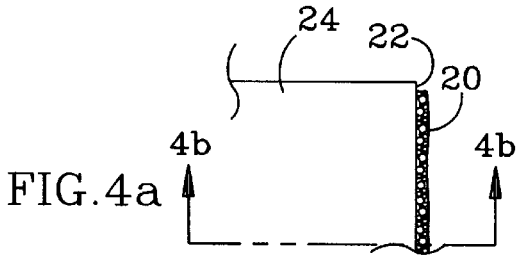
Figure 4B:
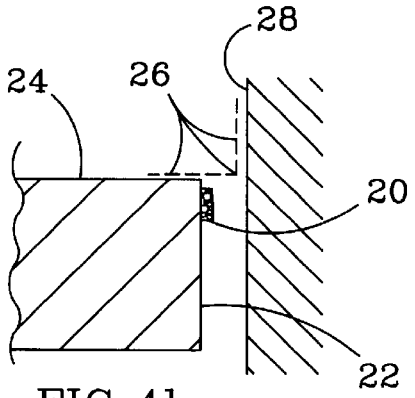

The present invention finds application wherever it is desired to apply a bead of caulking along the intersection between two surfaces, particularly when gaps are present through which caulking can fall. A method of bridging such gaps is detailed in the steps listed below; plan views of each step are shown in FIGS. 4*a*–7*a,* with corresponding sectional views shown in FIGS. 4*b*–7*b*:

1) FIGS. 4*a* and 4*b*: An expandable material 20 is adhered to a first surface 22 which is adjoining and typically perpendicular to a second surface 24 that will form an L-shaped corner 26 when the first surface is abutted against a third surface 28, such as a wall (shown in FIG. 4*b* for reference). For example, the first and second surfaces may be the back and top sides, respectively, of a countertop backsplash, or the vertical and horizontal sides, respectively, of a bathtub. The expandable material 20 is preferably attached about 0.32 cm to 0.16 cm (⅛" to 1/16") below the corner 26. The expandable material 20 is preferably adhered to the first surface 22 prior to its being placed against the third surface 28, while there is still easy access to surface 22.

Figure 5A:
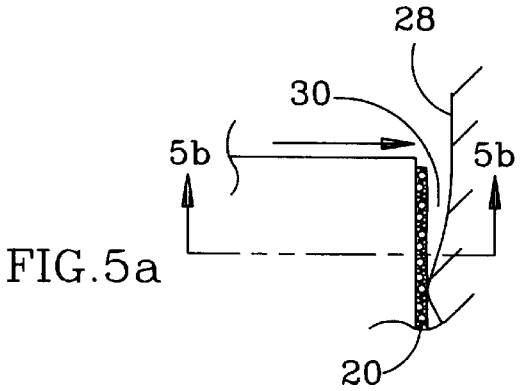
Figure 5B:
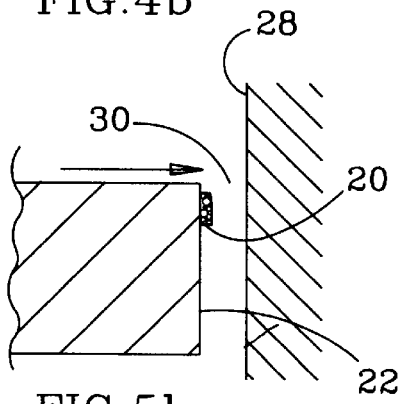

2) FIGS. 5*a* and 5*b*: The first surface 22 is pushed firmly against the third surface 28. However, due to the unevenness of the first and/or third surfaces, a gap 30 occurs between the first and third surfaces.

Figure 6A:
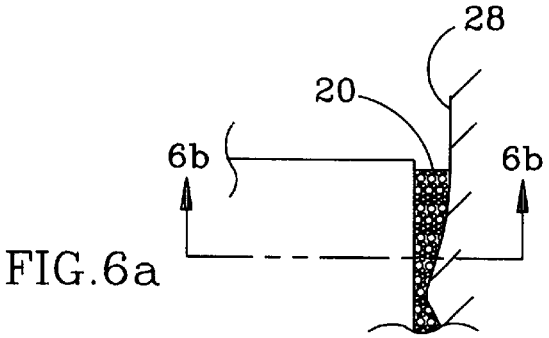
Figure 6B:
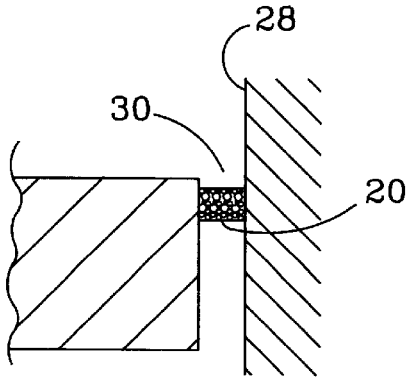

3) FIGS. 6*a* and 6*b*: The expandable material 20 is made to expand. If the width of the gap 30 is less than the expanded thickness of the expandable material, the gap is completely bridged.

Figure 7A:
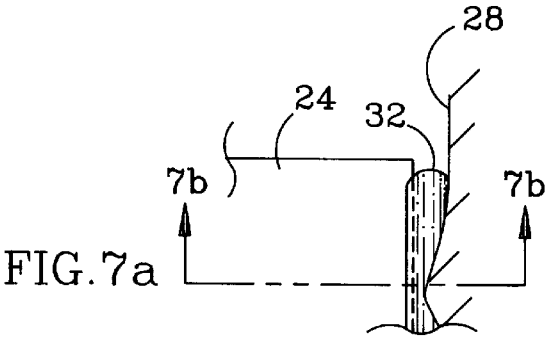
Figure 7B:
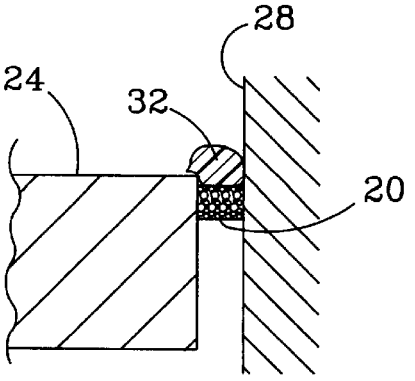

4) FIGS. 7*a* and 7*b*: A bead of caulking 32 is now applied atop the expandable material 20. To create a good seal, the caulking should touch both of the surfaces 24, 28 forming the corner.

The steps described above can be used to bridge any gap to be caulked, as long as the width of the gap does not exceed the maximum thickness of the expandable material.

The caulking support strip shown in FIGS. 1*a,* 1*b,* 2*a* and 2*b* is ideally suited for practicing the method described above. Expandable material 20 is preferably a compressed cellulose sponge material, attached to surface 22 with a two-sided adhesive tape (FIGS. 4*a* and 4*b*). For example, when installing a countertop, surface 22 is the side of the backsplash that abuts the wall, i.e., surface 28. The top of the backsplash is surface 24, with caulking to be applied in the L-shaped corner 26 formed by the intersection of the wall 28 and the top of the backsplash 24. Gap 30 occurs due to the unevenness of wall 28 (FIGS. 5*a* and 5*b*). The sponge is wetted, and expands as needed to bridge the gap (FIGS. 6*a* and 6*b*). A bead of caulking 32 is then applied along the top of the expanded sponge to form a seal along the intersection of the backsplash and wall (FIGS. 7*a* and 7*b*).

Other materials can also be used to practice the described method. It is only essential that the expandable material used be capable of supporting a bead of caulking when expanded, and that a means of attaching the expandable material to an appropriate surface is provided. Also, as shown in FIG. 6*a,* gaps to be filled typically do not have a consistent width. It is recommended that the expandable material remain malleable enough when expanded to be able to conform itself to variations in gap width, in the way that a sponge or an inflatable material would.

While particular embodiments of the invention have been shown and described, numerous variations and alternate embodiments will occur to those skilled in the art. Accordingly, it is intended that the invention be limited only in terms of the appended claims.

We claim:

1. A method of providing a support surface across a gap between two surfaces for supporting a bead of caulking, comprising the steps of:

adhering a first side of a layer of compressed cellulose sponge having opposing first and second sides to one of the surfaces on one side of a gap which is to be spanned with caulking, moistening said sponge layer such that said second side moves away from said first side so that said sponge layer becomes thicker to substantially cross said gap, said expanded sponge layer providing a support surface upon which caulking can be applied, and applying caulking on said support surface.

2. The method of claim 1, wherein said adhering is accomplished with an adhesive tape which is sticky on both sides.

3. The method of claim 1, wherein said compressed cellulose sponge is less than 0.32 cm (⅛") thick when not expanded and at least 1.27 cm (½") thick when expanded.

4. A method of securely affixing an adhesive tape to a sponge material, comprising the steps of:

rolling the adhesive tape onto the sponge material, exposing the tape and sponge material to an elevated temperature of between 93.3 and 107.2 degrees C. (200 and 225 degrees F.) for a period of between 15 and 20 seconds, and subjecting the tape and sponge material to a pressure of about $8.24\times10^5$ N/m$^2$ (120 psi).

5. The method of claim 4, wherein said sponge material is compressed cellulose sponge.

* * * * *